United States Patent [19]

Simson

[11] 4,011,086

[45] Mar. 8, 1977

[54] PHOTOGRAPHIC EMULSIONS AND ELEMENTS CONTAINING RIGIDIZED CARBOCYANINE DYES

[75] Inventor: Joseph Michael Simson, Rochester, N.Y.

[73] Assignee: Eastman Kodak Company, Rochester, N.Y.

[22] Filed: Oct. 14, 1975

[21] Appl. No.: 621,903

[52] U.S. Cl. ..... 96/136; 96/141; 260/256.4 F; 260/256.5 R

[51] Int. Cl.[2] ..... G03C 1/18

[58] Field of Search ..... 96/120, 130, 139, 140, 96/141, 136

[56] References Cited

UNITED STATES PATENTS

| | | | |
|---|---|---|---|
| 2,478,367 | 8/1949 | Brooker et al. | 96/139 |
| 3,679,427 | 7/1972 | Lincoln et al. | 96/120 |
| 3,821,233 | 6/1974 | Lincoln et al. | 96/120 |
| 3,904,637 | 9/1975 | Lincoln et al. | 96/120 |

*Primary Examiner*—J. Travis Brown
*Attorney, Agent, or Firm*—J. G. Levitt

[57] ABSTRACT

Photographic silver halide emulsions and elements containing completely rigidized carbocyanine dyes which can be represented by the general formula:

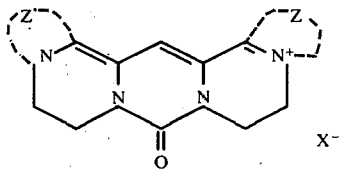

wherein:

a. Z represents the atoms necessary to complete a heterocyclic nucleus of the type found in cyanine dyes useful as sensitizers in photographic silver halide emulsions, and b. $X^-$ represents an anion.

6 Claims, No Drawings

PHOTOGRAPHIC EMULSIONS AND ELEMENTS CONTAINING RIGIDIZED CARBOCYANINE DYES

This invention relates to photographic silver halide emulsions containing a new class of completely rigidized carbocyanine dyes which are especially useful as sensitizers for infrared radiation and to photographic elements including such emulsions.

Dyestuffs, including carbocyanine dyes are well-known in the chemical arts. They generally are known to be useful as coloring materials for such items as plastics, textile fibers, coating materials and the like. Additionally, certain dyes are known to be useful as spectral sensitizing dyes for photographic silver halide emulsions. Presently known carbocyanine dyes generally include two terminal heterocyclic nuclei joined by an open (non-cyclic) trimethine chain, although dyes are also known, for example the cyanine dyes described in U.S. Pat. No. 2,478,367 in which a portion of the methine chain is included in a ring system.

Open-chain polymethine dyes are capable of existing in numerous stereoisomeric configurations, and are capable of undergoing numerous rotational and translational modes of vibration. Such a potential multiplicity of form contributes both to an undesirably wide spectral absorption envelope and decreased chemical stability of the dye, especially in solution. On the other hand, certain simple cyanine dyes of the type described in U.S. Pat. No. 2,478,367, exhibit a type of rigidized structure wherein the methine carbon atoms and adjoining nitrogen atoms of the terminal heterocyclic nuclei are integrated with additional methylene groups to form a single, seven-membered heterocyclic ring. The formation of this ring contributes to a desirable narrowing of the absorption envelope for those dyes by restricting the number of distinct stereoisomers in which this rigidized dye molecule can exist. Additionally, the stability of the dye in solution is increased. Such dyes tend to exhibit higher fluorescence capabilities than do similar, but non-rigidized dyes.

Rigidized carbocyanine dyes are also known in the art. For example, U.S. Pat. Nos. 3,679,427, 3,821,233 and 3,864,644 relate to dyes of this type. These dyes are described as being good sensitizers as well as fluorescent with their peak sensitivity in the short red region of the visible spectrum i.e., at about 600 nm. It would be advantageous, therefore, to provide rigidized sensitizing dyes capable of exhibiting relatively longer wavelength absorbencies, such as in the infrared region of the spectrum.

In accordance with the present invention, there is provided a new class of carbocyanine dyes, which new dyes are completely rigidized, and include at least two nitrogen-containing heterocyclic nuclei joined by a polyene chain having five carbon atoms with alternating single and double bonds of equal number, the terminal carbon atom of the polyene chain being in each of the two heterocyclic nuclei and bonded directly to a nitrogen atom thereof, with the polyene chain itself comprising a portion of a rigidizing dye. These rigidized carbocyanine dyes exhibit long wavelength absorption ($\lambda_{max}$>740 nm.) as well as efficient fluorescence properties.

Preferably, the dyes can be represented by the formula:

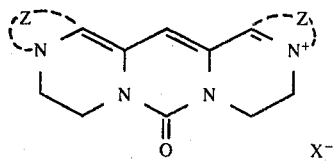

I.

wherein:

a. Z represents the atoms necessary to complete a heterocyclic nucleus of the type found in cyanine dyes useful as sensitizers in photographic silver halide emulsions, and b. $X^-$ represents an anion.

Z defines heterocyclic nuclei of the type used in cyanine dyes which are useful as spectral sensitizers in photographic silver halide emulsions. These heterocyclic nuclei are well-known, art-recognized groups and include the non-metallic atoms necessary to complete a heterocyclic nucleus as in formula I above and preferably have therein at least one hetero atom selected from either nitrogen, oxygen, sulfur or selenium in addition to the nitrogen atom shown in formula I. The heterocyclic nuclei illustrated by Z preferably include those containing a heterocyclic ring of from 5 to 6 nuclear atoms including the chromophoric nitrogen atom shown in formula I, from 3 to 4 carbon atoms and one additional hetero atom which is either nitrogen, oxygen, sulfur or selenium. The heterocyclic nuclei can, of course, be substituted with substituents that do not adversely affect the spectral sensitizing efficiency of the dye. Examples of heterocyclic nuclei used in spectral sensitizing cyanine dyes can be found in the publications cited in *Product Licensing Index*, Vol. 92, December 1971 at paragraph XV(B), pages 108 and 109.

Exemplary of the useful heterocyclic nuclei which can be present as the aforementioned part of the completely rigidized carbocyanine spectral sensitizing compounds of this invention include, for example, those nuclei of the imidazole series such as benzimidazole, 5-chlorobenzimidazole and also including nuclei of the naphthimidazole series such as alphanaphthimidazole, 8-ethoxy-alpha-naphthimidazole, etc.; those of the thiazole series like thiazole, 4-methylthiazole, 4-phenylthiazole, 5-methylthiazole, 5-phenylthiazole, 4,5-dimethylthiazole, 4,5-diphenylthiazole, 4-(2-thienyl)-thiazole, etc.; those of the benzothiazole series such as benzothiazole, 4-methoxybenzothiazole, 5-chlorobenzothiazole, 6-chlorobenzothiazole, 7-methoxybenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, etc.; those of the naphthothiazole series like alpha-naphthothiazole, 8-methoxy-alpha-naphthothiazole, 7-methoxy-alpha-naphthothiazole, etc.; those of the thionaphtheno-7′,-6′,4,5-thiazole series such as 4-methoxythionaphtheno-7′,6′,4,5-thiazole, etc.; those of the oxazole series for example, 4-methyloxazole, 5-methyloxazole, 4-phenyloxazole, 4,5-diphenyloxazole, 4-ethyloxazole, 4,5-dimethyloxazole, 5-phenyloxazole, etc.; those of the benzoxazole series like benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 5-chlorobenzoxazole, 6-methoxybenzoxazole, 5-hydroxybenzoxazole, 6-hydroxybenzoxazole, etc.; those of the naphthoxazole series such as alphanaphthoxazole, etc.; those of the selenazole series, for example, 4-methylselenazole, 4-phenylselenazole, etc., those of the benzoselenazole series like benzoselenazole, 5-chlorobenzoselenazole, 5-methoxybenzoselenazole, 5-hydroxybenzoselenazole, tetrahydrobenzoselenazole, etc.; those of the naphthoselenazole series such as alpha-naphthoselenazole, 7-methoxy-alpha-naphthoselenazole, etc.; and those of the quinoline series such as quinoline, 4-methylquinoline, etc.

The anions represented by $X^-$ include a wide variety of anions like bromide, chloride and iodide, as well as additional anions, e.g., sulfates, including sulfate, hydrosulfate and lower alkyl sulfates like methylsulfate, aromatic sulfonates such as p-toluene sulfonate and benzene sulfonate, acid anions derived from carboxylic acids like acetate, trifluoroacetate, propionate, benzoate, and a wide variety of other anions including anions such as, for example, perchlorate, cyanate, thiocyanate, sulfamate, etc.

The completely rigidized carbocyanine dyes of this invention are useful in the spectral sensitization of photographic silver halide emulsions, when incorporated therein, to the infrared region of the electromagnetic spectrum. The dyes are especially useful for extending the spectral sensitivity of the customarily employed silver chloride, silver chlorobromide, silver bromide, silver bromoiodide, and silver chlorobromoiodide developing out emulsions using a hydrophilic colloid carrier or binding agent such as gelatin, its water-soluble derivatives, polyvinyl alcohol, its water-soluble polyvinyl derivatives such as polyacrylamide imidized polyacrylimide, etc., and other water-soluble film-forming materials that form water-permeable coatings, such as colloidal albumin, water-soluble cellulose derivatives like carboxymethylcellulose, etc.

The binding agents for the emulsion layer of a photographic element can also contain dispersed polymerized vinyl compounds. Certain such compounds are disclosed, for example, in U.S. Pat. Nos. 3,142,568 of Nottorf issued July 28, 1964; U.S. Pat. No. 3,193,386 of White issued July 6, 1965; U.S. Pat. No. 3,062,672 of Houch et al. issued Nov. 6, 1962; and U.S. Pat. No. 3,220,844 of Houck et al. issued Nov. 30, 1965; and include the water-insoluble polymers and latex copolymers of alkyl acrylates and methacrylates, acrylic acid sulfoalkyl acrylates or methacrylates and the like.

To prepare emulsions sensitized with one or more of the dyes described herein, it is only necessary to disperse the dye or dyes in the emulsions. The methods of incorporating dyes in emulsions are simple and well known to those skilled in the art. In practice, it is convenient to add the dyes to the emulsion in the form of a solution in a suitable solvent. Methanol, ethanol, propanol, etc., acetone and/or pyridine are used to advantage. The dyes are advantageously incorporated in the finished washed emulsions, and are desirably uniformly distributed throughout the emulsions adsorbed to the surface of the silver halide grain.

A sensitizing concentration of dyes in emulsions can vary widely e.g., from 10 to 1000 mg. per mole of silver halide and preferably from 20 to 200 mg. per mole of silver halide and will depend upon the type of emulsion and the effect desired. The suitable and most economical concentration for any given emulsion will be apparent to those skilled in the art, upon making the ordinary tests and observations customarily used in the art of emulsion making.

To prepare a hydrophilic colloid-silver halide emulsion sensitized with one or more of the dyes of this invention, one can employ the following procedure. A quantity of dye is dissolved in a suitable solvent, such as an alcohol, acetone, pyridine, etc. Then a volume of this solution, which may be diluted with water, containing the dye, is slowly added to, for example, a gelatino-silver halide emulsion, with stirring. Stirring is continued until the dye is uniformly dispersed in the emulsion.

The above statements are only illustrative, as it will be apparent that the sensitizing dyes of this invention can be incorporated in photographic emulsions by any of the methods customarily employed in the art, e.g., by bathing a plate or film upon which an emulsion is coated in a solution of the dye in an appropriate solution of the dye. However, bathing methods are not preferred.

The emulsions used in the photographic elements of this invention can also be sensitized with chemical sensitizers, such as with reducing agents; sulfur, selenium or tellurium compounds; gold, platinum or palladium compounds; or combinations of these. Suitable procedures are described in Shepard U.S. Pat. No. 1,623,499; Allen U.S. Pat. No. 2,399,083; McVeigh U.S. Pat. No. 3,297,447; and Dunn U.S. Pat. No. 3,297,446.

The silver halide emulsions described herein can also be protected against the production of fog and can be stabilized against loss of sensitivity during keeping. Suitable antifoggants and stabilizers each used alone or in combination include the thiazolium salts described in Staud U.S. Pat. No. 2,131,038 and Allen U.S. Pat. No. 2,694,716; the azaindenes described in Piper U.S. Pat. No. 2,886,437 and Heimbach U.S. Pat. No. 2,444,605, the mercury salts as described in Allen U.S. Pat. No. 2,728,663; the urazoles described in Anderson U.S. Pat. No. 3,287,135; the sulfocatechols described in Kennard U.S. Pat. No. 3,236,652; the oximes described in Carroll et al. British Pat. No. 623,448; nitron; nitroindazoles; the mercaptotetrazoles described in Kendall et al U.S. Pat. No. 2,403,927, Kennard et al. U.S. Pat. No. 3,266,897 and Luckey et al. U.S. Pat. No. 3,397,987; the polyvalent metal salts described in Jones U.S. Pat. No. 2,839,405; the thiuronium salts described in Herz U.S. Pat. No. 3,220,839; the palladium platinum and gold salts described in Trivelli U.S. Pat. No. 2,566,263 and Damschroder U.S. Pat. No. 2,597,915.

As well as including the above-mentioned addenda, the silver halide emulsions employed in this invention can be hardened with any suitable hardener or combinations such as, e.g., formaldehyde, mucochloric acid, glutaraldehyde, maleic dialdehyde, aldehyde hardeners, aziridine hardeners, hardeners which are derivatives of dioxane, vinyl sulfones, oxypolysaccharides such as oxystarch, oxy plant gums, inorganic hardeners such as chromium salts, and the like.

The photographic silver halide emulsions or coatings disclosed herein can also contain non-ionic, anionic and/or amphoteric coating aids. Some useful coating aids include, for example, saponin, alkyl substituted aryloxyalkylene ether sulfonates of the type described in U.S. Pat. No. 2,600,831 issued June 17, 1952, maleopimarates of the type described in U.S. Pat. No. 2,823,123, issued Feb. 11, 1958, taurine derivatives of the type described in U.S. Pat. No. 2,739,891 issued on Mar. 27, 1956, and alkylaminopropionates of the type described in U.S. Pat. No. 3,133,816 issued May 19, 1964. Still other good coating aids and surfactants which can be employed in the emulsions of this invention include the alkylphenoxy poly(hydroxyalkylene oxides) such as alkylphenoxy poly(glycidols) having from about 5 to about 12 glycidol units, for example, such as those disclosed in British Pat. No. 1,022,878 issued Mar. 16, 1966, to Olin Mathieson.

Additionally, the completely rigidized dyes of this invention can be employed in combination with other spectral sensitizing dyes to confer additional spectral sensitivity to light-sensitive silver halide emulsions of the types described herein. Other sensitizing dyes which may be used in combination with the present dyes are described, for example, in Brooker and White U.S. Pat. No. 2,526,632, issued Oct. 24, 1950; Sprague U.S. Pat. No. 2,503,776, issued Apr. 11, 1950; Brooker et al. U.S. Pat. No. 2,493,748; and Taber et al. U.S. Pat. No. 3,384,486 as well as numerous other literature references. Spectral sensitizers which can be used in combination with the present dyes include the cyanines, merocyanines, complex (tri or tetranuclear) merocyanines, complex (tri or tetranuclear) cyanides, holopolar cyanines, styryls, hemicyanines (e.g., enamine hemicyanines), oxonols and hemioxonols.

Dyes of the cyanine class typically contain such basic nuclei as thiazole, oxazole, selenazole, quinoline and imidazole nuclei. Such nuclei may contain alkyl, alkylene, hydroxyalkyl, sulfoalkyl, carboxyalkyl, aminoalkyl and enamine groups and may be fused to carbocyclic or heterocyclic ring systems either unsubstituted or substituted with halogen, phenyl, alkyl, haloalkyl, cyano, or alkoxy groups.

The additional spectral sensitization (by use of additional sensitizing dyes in combination with one or more of the completely rigidized carbocyanine dyes of this invention) can be accomplished by simply mixing into the emulsion a solution of the other sensitizing dye(s) in an organic solvent. Or such dye(s) may be added in the form of a dispersion as described in Owens et al. French Pat. No. 1,482,774. For optimum results, the sensitizing dye is preferably added to the emulsion just before the coating step. However, it can be added at some earlier stage, if desired, The completely rigidized cyanine dyes of this invention are especially preferred as spectral sensitizers for emulsions which contain color-forming couplers, such as those described in the references cited in *Product Licensing Index*, Vol. 92, December 1971, page 110 at paragraph XXII. Especially useful couplers are the cyan dye forming couplers.

To prepare photographic elements, at least one silver halide emulsion of the disclosed type and containing at least one of the completely rigidized carbocyanine dyes of this invention is coated in a conventional manner onto a typical photographic support material and dried. Coating of single and multi-layer photographic elements can be accomplished by a wide variety of techniques including hopper coating, flow coating, etc., which techniques are well known in the art. Advantageous support materials include conventional photographic film base materials like cellulose esters such as cellulose nitrate, cellulose acetate, cellulose triacetate, cellulose acetate butyrate, etc., polyolefins like polyethylene, and polypropylene, polycarbonates, polyesters such as poly(ethylene terephthalate) as well as metals such as zinc and aluminum and paper including baryta coated paper, polyethylene and polypropylene-coated papers. Other support materials that are suitably used herein are also well known in the art, e.g., papers coated with copolymers of ethylenebutene.

The completely rigidized dyes of the present invention can be prepared generally by selecting a compound which constitutes the heterocyclic nucleus of the type defined by Z in which the carbon atom adjacent to the nitrogen atom (that which will form part of the polyene chain) is substituted with a mono-halogen substituted methyl group. This heterocyclic precursor is reacted first with 2-aminoethanol, and subsequently heated with a suitable acid such as para-toluenesulfonic acid to yield a closed ring intermediate which can be generally represented by the formula:

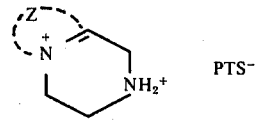

II.

wherein Z is any of the heterocyclic nuclei attributed to Z in formula I, above. The intermediate is then reacted first with trifluoroacetic anhydride, and second with diethoxymethyl acetate, using a basic organic solvent such as pyridine as a reaction medium, to produce a second intermediate which can be represented by the general formula III:

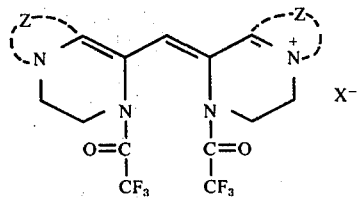

III.

wherein X in this instance is para-toluenesulfonate ($PTS^-$), Z is the same well-known heterocyclic nuclei as described hereinabove as useful in photographically sensitizing cyanine dyes. The heterocyclic nuclei represented by Z would be the same on each side of the molecule of the intermediate. The second intermediate is then reacted with a basic condensing agent such as triethylamine to yield the final rigidized dye as previously represented by formula I.

The heterocyclic nuclei represented by Z on the intermediate can be varied such that the rigidized dye formed will have corresponding nuclei and will include heterocyclic nuclei of the type found in cyanine dyes useful as sensitizers in photographic silver halide emulsion. Using intermediates of structure II:

Z and $X^-$ can be varied such that the rigidized dye formed has the corresponding heterocyclic nuclei defined by Z and the anion defined by $X^-$. In all cases the final step involves hydrolysis of one trifluoroacetyl group followed by elimination of a trifluoromethyl group. The following table lists possible Z and $X^-$ groups and the dyes that will be formed by reaction of a compound of formula III with a basic condensing agent.

For example, $X^-$ can be varied by using a different selected acid in the reaction step that results in the formation of a compound having structure II, above.

The following illustrative examples are included for a further understanding of the invention.

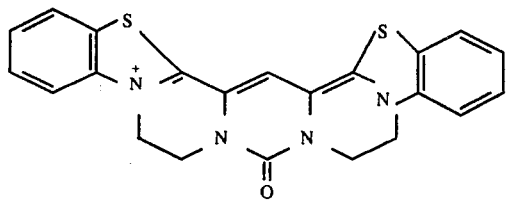

Table 1

| | Z | $X^-$ | Dye Formed | $I^-$ |
|---|---|---|---|---|
| 1. | benzimidazole | chloride | 6,7,11,12-tetrahydro-9-oxo-9H-bisbenzoimidazolo[3,2-a:3',2'-a']-pyrimido[6,1-c:4,3-c']dipyrazin-5-ium chloride | 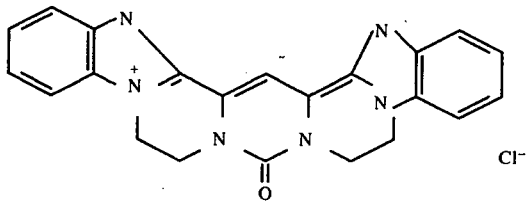 |
| 2. | benzoxazole | iodide | 6,7,11,12-tetrahydro-9-oxo-9H-bisbenzoxazolo[3,2-a:3',2'-a']-pyrimido[6,1-c:4,3-c']dipyrazin-5-ium iodide | 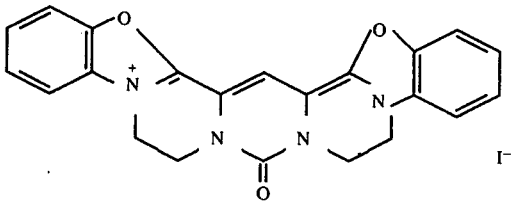 |
| 3. | selenazole | bromide | 6,7,11,12-tetrahydro-9-oxo-9H-bisselenazolo[3,2-a:3',2'-a'] pyrimido[6,1-c:4,3-c']dipyrazin-5-ium bromide | 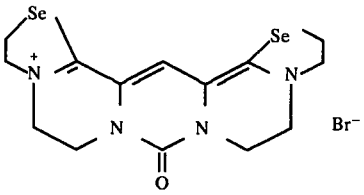 |
| 4. | oxazole | bromide | 6,7,11,12-tetrahydro-9-oxo-9H-bisoxazolo[3,2-a:3',2'-a']-pyrimido[6,1-c:4,3-c']dipyrazin-5-ium bromide | 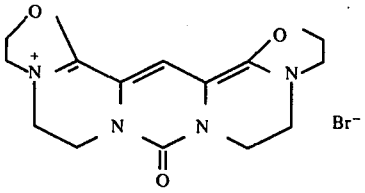 |
| 5. | thiazole | chloride | 6,7,11,12-tetrahydro-9-oxo-9H-bisthiazolo[3,2-a:3',2'-a']-pyrimido[6,1-c:4,3-c']dipyrazin-5-ium chloride | 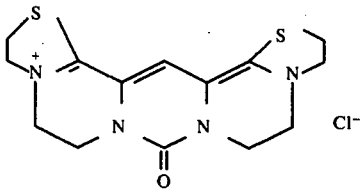 |
| 6. | benzo-selenazole | chloride | 6,7,11,12-tetrahydro-9-oxo-9H-bisbenzoselenazolo[3,2-a:3',2'-a']-pyrimido[6,1-c:4,3-c']dipyrazin-5-ium chloride | 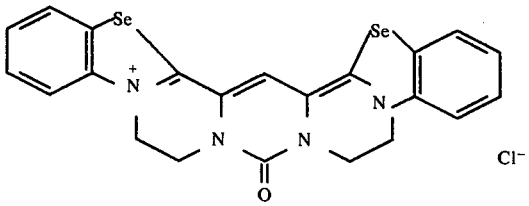 |

EXAMPLE 1 Manufacture of Rigidized Dye 6,7,11,12-Tetrahydro-9-oxo-9H-bisbenzothiazolo-[3,2-a:3',2'-a']pyrimido[6,1-c:4,3-c']dipyrazin-5-ium iodide was prepared as follows: 1.2g(0.012 mole) of triethylamine was added to 2.1g(0.003 mole) of 3,3'-ditrifluoroacetyl-4,4'-(1,2,3,4-tetrahydropyrazino[2,1-b]benzothiazolo)cyanine iodide slurried in 10 ml. of methanol. The mixture was heated to boiling and continued until the color change was complete. The precipitated dye was then purified by filtering the reaction mixture, cooling the collected precipitate, washing the precipitate with methanol, and then drying it. The yield of dye was 1.3g (80% of theoretical), m.p.>300° C; $\lambda_{max}$, 740 nm; $\epsilon_{max}$, $7.6\times10^4$ in methanol.

EXAMPLE 2 Manufacture of Rigidized Dye 6,7,11,12-Tetrahydro-3,13-dimethoxy-9-oxo-9H-bis-benzothiazolo[3,2-a:3'2'-a']pyrimido[6,1-c:4,3-c']-dipyrazin-5-ium iodide

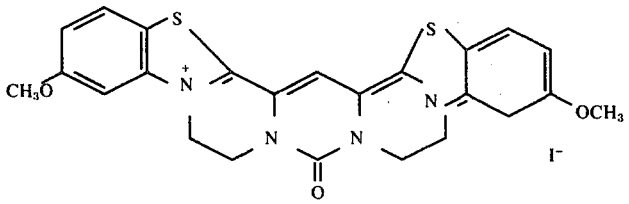

was prepared as follows: 0.5 ml of a 50% sodium hydroxide solution was added to 0.3g (0.39 moles) of 8,8'-dimethoxy-3,3'-bis(trifluoroacetyl)-4,4'-(1,2,3,4-tetrahydropyrazino[2,1-b]benzothiazolo)cyanine iodide slurried in a solution of 10 ml of acetonitrile and 2 ml of water. The mixture was stirred at room temperature until the purple color completely disappears. The solid dye was filtered and washed well with water, yielding 0.10g (42% of theoretical), m.p.>300° C; $\lambda_{max}$, 752 nm; $\epsilon_{max}$, $6.0\times10^4$ in methanol.

EXAMPLE 3 Illustration of Photographic Utility

The dyes prepared in Examples 1 and 2 were tested in an otherwise conventional 0.2 micrometer sulfur- and gold-sensitized, cubic-grained-gelatino-silver-bromoiodide emulsion containing 2.5 mole percent iodide by adding each to separate portions of the emulsion in the concentrations indicated in Table 2 and coated at 100 mg/ft$^2$ of silver on a cellulose acetate support. A sample of each coating was hypersensitized with ammonia and exposed to a tungsten light source in an Eastman 1B Sensitometer through a wedge spectrograph and continuous step wedge using no filter. The coatings were processed for six minutes in Kodak Rapid X-ray Developer, fixed, washed, and dried. The results are listed in Table 2.

Table 2

| Example No. | Dye Conc. In Emulsion | Sensitivity Range (nm) | Sensitivity Maximum (nm) |
|---|---|---|---|
| 1 | 100 mg/mole Ag | 680–830 | 800 |
| 2 | 100 mg/mole Ag | 760–830 | 800 |

The dyes were found to be useful sensitizers into the infrared region of the spectrum with peak sensitivity for both dyes at 800 nm.

The invention has been described in detail with particular reference to preferred embodiments thereof, but, it will be understood that variations and modifications can be effected within the spirit and scope of the invention.

I claim:

1. A photographic silver halide emulsion containing a completely rigidized dye having the formula:

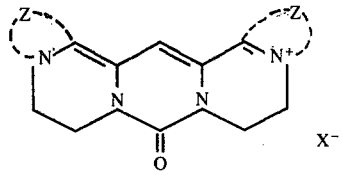

wherein:

a. Z represents the atoms necessary to complete a heterocyclic nucleus selected from the group consisting of an imidazole nucleus, an oxazole nucleus, a thiazole nucleus, a selenazole nucleus and a quinoline nucleus, and b. $X^-$ represents an anion.

2. A photographic silver halide emulsion containing the dye 6,7,11,12-tetrahydro-9-oxo-9H-bisbenzothiazolo[3,2-a:3',2'-a']pyrimido[6,1-c:4,3-c']dipyrazin-5-ium iodide.

3. A photographic silver halide emulsion containing the dye 6,7,11,12-tetrahydro-3,13-dimethoxy-9-oxo-9H-bisbenzothiazolo[3,2-a:3',2'-a']pyrimido[6,1-c:4,3-c']dipyrazin-5-ium iodide.

4. A photographic element including at least one silver halide emulsion layer containing a completely rigidized dye having the formula:

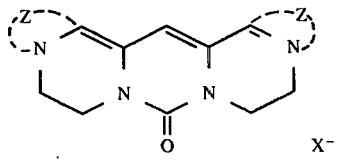

wherein:

a. Z represents the atoms necessary to complete heterocyclic nuclei selected from the group consisting of an imidazole nucleus, an oxazole nucleus, a thiazole nucleus, a selenazole nucleus and a quinoline nucleus, and b. $X^-$ represents an anion.

5. A photographic element as in claim 4 wherein the dye is 6,7,11,12-tetrahydro-9-oxo-9H-bisbenzothiazolo-[3,2-a:3',2'-a']pyrimido[6,1-c:4,3-c']dipyrazin-5-ium iodide.

6. A photographic element as in claim 4 wherein the dye is 6,7,11,12-tetrahydro-3,13-dimethoxy-9-oxo-9H-bisbenzothiazolo[3,2-a:3',2'-a']pyrimido[6,1-c:4,3-c']-dipyrazin-5-ium iodide.

* * * * *